US009669440B2

(12) United States Patent
Nakamura et al.

(10) Patent No.: US 9,669,440 B2
(45) Date of Patent: Jun. 6, 2017

(54) FORMED MATERIAL MANUFACTURING METHOD AND FORMED MATERIAL

(71) Applicant: NISSHIN STEEL CO., LTD., Tokyo (JP)

(72) Inventors: Naofumi Nakamura, Osaka (JP); Yudai Yamamoto, Osaka (JP); Jun Kurobe, Osaka (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 14/769,669

(22) PCT Filed: May 14, 2014

(86) PCT No.: PCT/JP2014/062849
§ 371 (c)(1),
(2) Date: Aug. 21, 2015

(87) PCT Pub. No.: WO2015/141017
PCT Pub. Date: Sep. 24, 2015

(65) Prior Publication Data

US 2016/0207085 A1 Jul. 21, 2016

(30) Foreign Application Priority Data

Mar. 20, 2014 (JP) ..... 2014-057529

(51) Int. Cl.
*B21C 1/22* (2006.01)
*B21D 22/20* (2006.01)
*B21D 24/06* (2006.01)

(52) U.S. Cl.
CPC ..... *B21C 1/22* (2013.01); *B21D 22/20* (2013.01); *B21D 24/06* (2013.01)

(58) Field of Classification Search
CPC ..... B21D 22/28; B21D 51/263; Y10S 72/715
USPC ..... 413/73, 76; 72/347, 348, 349, 379.4
See application file for complete search history.

(56) References Cited

U.S. PATENT DOCUMENTS 4,522,049 A 6/1985 Clowes

FOREIGN PATENT DOCUMENTS

| | | | |
|---|---|---|---|
| JP | 59-178139 | A | 10/1984 |
| JP | 2013-51765 | A | 3/2013 |
| KR | 20000043810 | A | 7/2000 |
| KR | 20080056775 | A | 6/2008 |

OTHER PUBLICATIONS

A communication issued in corresponding Korean application 10-2015-7021517 dated Nov. 30, 2015, 3 pages.
Office Action issued in Japanese Patent Application No. 2014-117520 on Jun. 24, 2014 along with English translation, 9 pages.
Masao Murakawa et al.: "Basics of Plastic Forming", First Edition, Sangyo-Tosho Publishing Co. Ltd., Jan. 16, 1990, pp. 104 to 107.

*Primary Examiner* — Adam Krupicka
(74) *Attorney, Agent, or Firm* — Rothwell, Figg, Ernst & Manbeck, P.C.

(57) ABSTRACT

A formed material is manufactured by performing forming including at least one drawing-out process and at least one drawing process performed after the drawing-out process. A punch 31 used in the drawing-out process is formed to be wider on a rear end side than on a tip end side. By pushing a raw material metal plate into a pushing hole 30*a* together with the punch 31, ironing is performed on a region of the raw material metal plate corresponding to a flange portion.

6 Claims, 6 Drawing Sheets

FORMED MATERIAL MANUFACTURING METHOD AND FORMED MATERIAL

CROSS REFERENCE TO RELATED APPLICATIONS

This application is a 35 U.S.C. §371 National Phase Entry Application from PCT/JP2014/062849, filed May 14, 2014, and designating the United States, which claims priority under 35 U.S.C. §119 to Japanese Patent Application No. 2014-057529 filed Mar. 20, 2014, which is incorporated herein by reference in its entirety.

TECHNICAL FIELD

The present invention relates to a formed material manufacturing method for manufacturing a formed material having a tubular trunk portion and a flange portion formed on an end portion of the trunk portion, and the formed material.

BACKGROUND ART

As disclosed shown, for example, in Non-Patent Document 1 and so on, a formed material having a tubular trunk portion and a flange portion formed on an end portion of the trunk portion is manufactured by performing a drawing process. In the drawing process, the trunk portion is formed by stretching a raw material metal plate. Therefore, the plate thickness of the trunk portion becomes thinner than the plate thickness of the raw material. Meanwhile, the region of the metal plate corresponding to the flange portion undergoes overall shrinkage in response to formation of the trunk portion, and therefore the plate thickness of the flange portion becomes thicker than the plate thickness of the raw material.

A formed material such as that described above may be used as a motor case disclosed shown, for example, in Patent Document 1 and so on. In this case, the trunk portion is expected to perform as a shielding material that prevents magnetic leakage to the exterior of the motor case. Further, depending on the structure of the motor, the trunk portion is also expected to perform as a back yoke of a stator. The performance of the trunk portion as a shielding material or a back yoke improves as the thickness thereof increases. Therefore, when a formed material is manufactured by a drawing process as described above, a raw material metal plate having a thickness greater than the required plate thickness of the trunk portion is selected in consideration of the reduction in plate thickness that occurs during the drawing process. The flange portion, meanwhile, is often used to attach the motor case to an attachment object. The flange portion is therefore expected to have a fixed strength.

Non-Patent Document 1: "Basics of Plastic Forming", Masao Murakawa and three others, First Edition, SANGYO-TOSHO Publishing Co. Ltd., Jan. 16, 1990, pp. 104 to 107

Patent Document 1: Japanese Patent Application Publication No. 2013-51765

DISCLOSURE OF THE INVENTION

In a conventional formed material manufacturing method such as that described above, a formed material having a tubular trunk portion and a flange portion formed on an end portion of the trunk portion is manufactured by performing a drawing process, and therefore the plate thickness of the flange portion is thicker than the plate thickness of the raw material. The plate thickness of the flange portion may therefore become unnecessarily thick exceeding a plate thickness at which the flange portion exhibits an expected performance level. As a result, the formed material becomes unnecessarily heavy, which is problematic when the formed material is applied to a motor case or the like that needs to be lightweight.

The present invention has been designed to solve the problem described above, and an object thereof is to provide a formed material manufacturing method and a formed material, with which unnecessary increases in the thickness of the flange portion can be avoided, enabling reductions in weight of the formed material and the size of the raw material metal plate.

A formed material manufacturing method according to the present invention is a method of manufacturing a formed material having a tubular trunk portion and a flange portion formed on an end portion of the trunk portion, by performing at least two forming processes on a raw material metal plate, wherein the at least two forming processes include at least one drawing-out process and at least one drawing process performed after the drawing-out process, the drawing-out process is performed using a mold that includes a punch and a die having a pushing hole, a width of a rear end side of the punch is set to be wider than a width of a tip end side thereof so that a clearance between the die and the punch when the punch is pushed into the pushing hole in the die is narrower on the rear end side than on the tip end side, and ironing is performed on a region of the raw material metal plate corresponding to the flange portion by pushing the raw material metal plate into the pushing hole together with the punch during the drawing-out process.

Further, a formed material according to the present invention is manufactured by performing at least two forming processes on a raw material metal plate, the formed material having a tubular trunk portion and a flange portion formed on an end portion of the trunk portion, and the at least two forming processes including at least one drawing-out process and at least one drawing process performed after the drawing-out process, wherein a plate thickness of the flange portion is thinner than a plate thickness of a peripheral wall of the trunk portion by performing ironing on a region of the raw material metal plate corresponding to the flange portion during the drawing-out process.

Furthermore, a formed material according to the present invention is manufactured by performing at least two forming processes on a raw material metal plate, the formed material having a tubular trunk portion and a flange portion formed on an end portion of the trunk portion, and the at least two forming processes including at least one drawing-out process and at least one drawing process performed after the drawing-out process, wherein a plate thickness of the flange portion is thinner than a plate thickness of the raw material metal plate by performing ironing on a region of the raw material metal plate corresponding to the flange portion during the drawing-out process.

With the formed material manufacturing method and the formed material according to the present invention, ironing is performed on the region of the raw material metal plate corresponding to the flange portion by pushing the raw material metal plate into the pushing hole together with the punch during the drawing-out process, and therefore an unnecessary increase in the thickness of the flange portion can be avoided, enabling a reduction in the weight of the formed material. This configuration is particularly useful in an application such as a motor case that needs to be lightweight.

BEST MODE FOR CARRYING OUT THE INVENTION

Embodiments of the present invention will be described below with reference to the drawings.

First Embodiment

Figure 1:
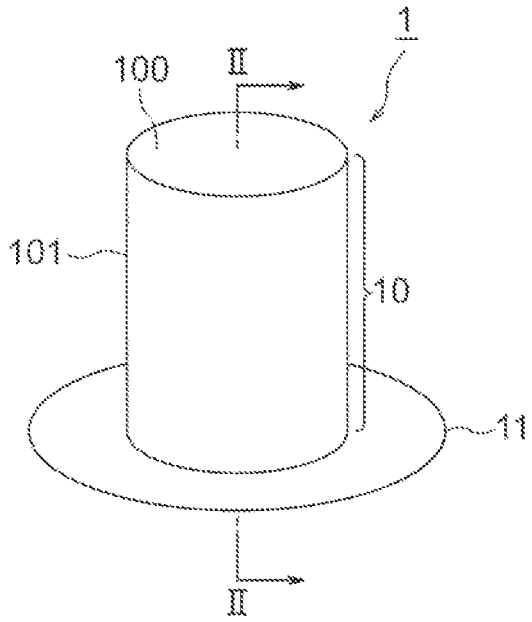
FIG. 1 is a perspective view showing a formed material manufactured by a formed material manufacturing method according to a first embodiment of the present invention.

FIG. 1 is a perspective view showing a formed material 1 manufactured by a formed material manufacturing method according to a first embodiment of the present invention. As shown in FIG. 1, the formed material 1 manufactured by the formed material manufacturing method according to this embodiment includes a trunk portion 10 and a flange portion 11. The trunk portion 10 is a tubular part having a top wall 100 and a peripheral wall 101 that extends from an outer edge of the top wall 100. Depending on the orientation in which the formed material 1 is used, the top wall 100 may be referred to using another term, such as a bottom wall. In FIG. 1, the trunk portion 10 is shown to have a perfectly circular cross-section, but the trunk portion 10 may have an elliptical sectional shape, a square tube shape, or another shape, for example. The top wall 100 may be subjected to further processing such as forming a projecting portion projecting from the top wall 100, for example. The flange portion 11 is a plate portion formed on an end portion of the trunk portion 10 (an end portion of the peripheral wall 101).

Figure 2:
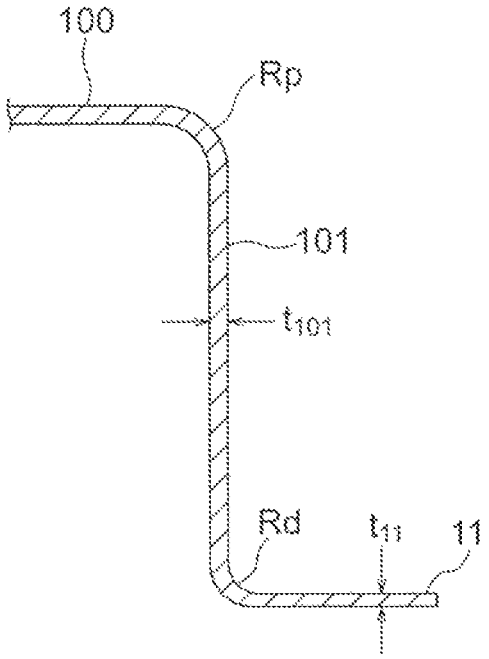
FIG. 2 is a sectional view taken along a II-II line in FIG. 1.

FIG. 2 is a sectional view taken along line II-II in FIG. 1. As shown in FIG. 2, a plate thickness $t_{11}$ of the flange portion 11 is thinner than a plate thickness $t_{101}$ of the peripheral wall 101 of the trunk portion 10. The reason for this, as will be described in detail below, is that ironing is performed on a region of a raw material metal plate 2 (see FIG. 3) corresponding to the flange portion 11. Note that the plate thickness $t_{11}$ of the flange portion 11 denotes an average value of the plate thickness of the flange portion 11 from a lower end of a lower side shoulder portion Rd between the peripheral wall 101 and the flange portion 11 and an outer end of the flange portion 11. Similarly, the plate thickness $t_{101}$ of the peripheral wall 101 denotes an average value of the plate thickness of the peripheral wall 101 from an upper end of the lower side shoulder portion Rd to a lower end of an upper side shoulder portion Rp.

Figure 3:
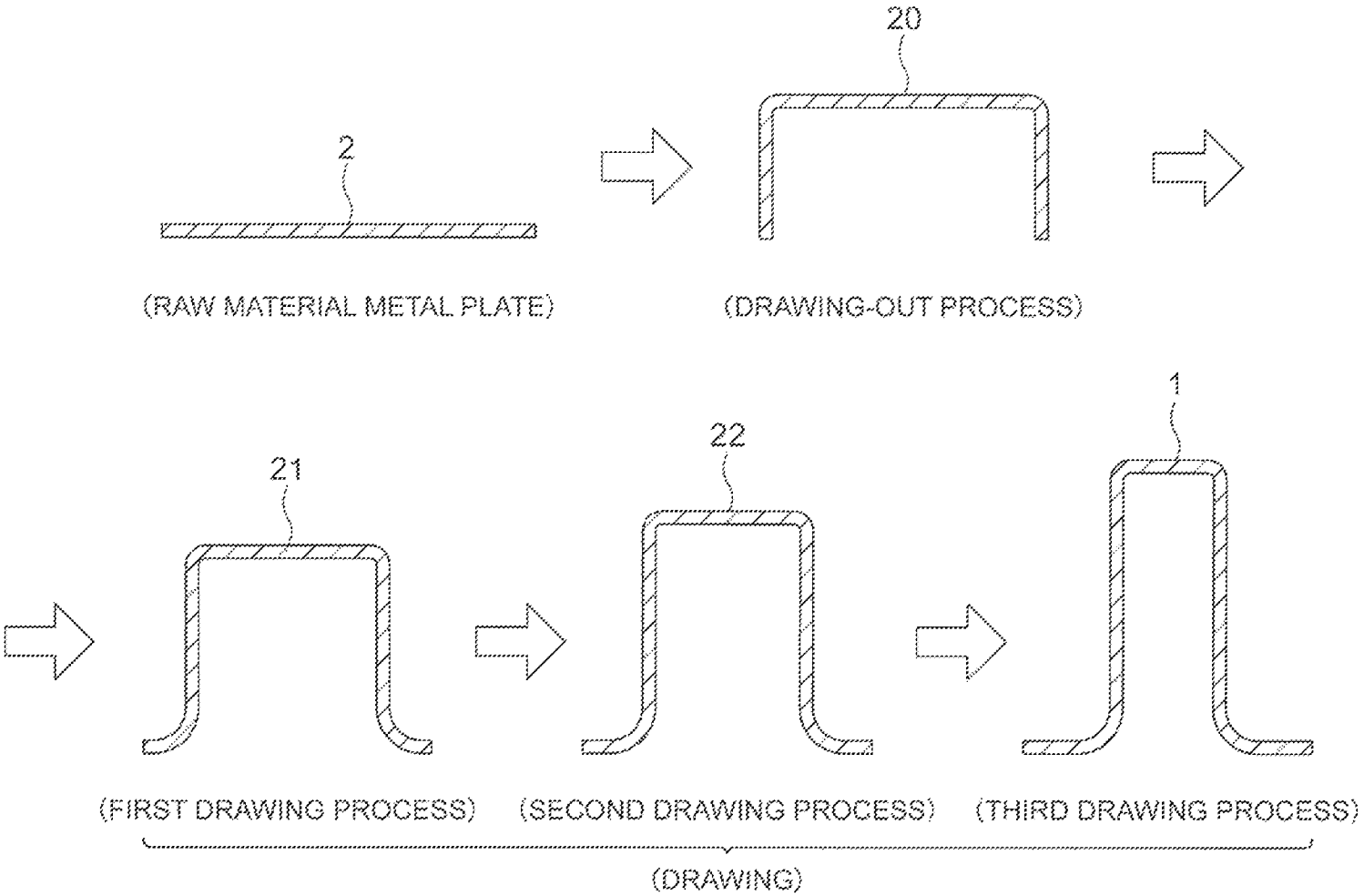
FIG. 3 is an illustrative view showing a formed material manufacturing method for manufacturing the formed material of FIG. 1.

FIG. 3 is an illustrative view showing a formed material manufacturing method for manufacturing the formed material 1 of FIG. 1. In the formed material manufacturing method according to the present invention, the formed material 1 is manufactured by performing at least two forming processes on the flat plate-shaped raw material metal plate 2. The at least two forming processes include at least one drawing-out process and at least one drawing process performed after the drawing-out process. In the formed material manufacturing method according to this embodiment, the formed material 1 is manufactured by one drawing-out process and three drawing processes (first to third drawing processes). Various types of metal plate, such as cold rolled steel plate, stainless steel plate, and coated steel plate, may be used as the raw material metal plate 2.

Figure 4:
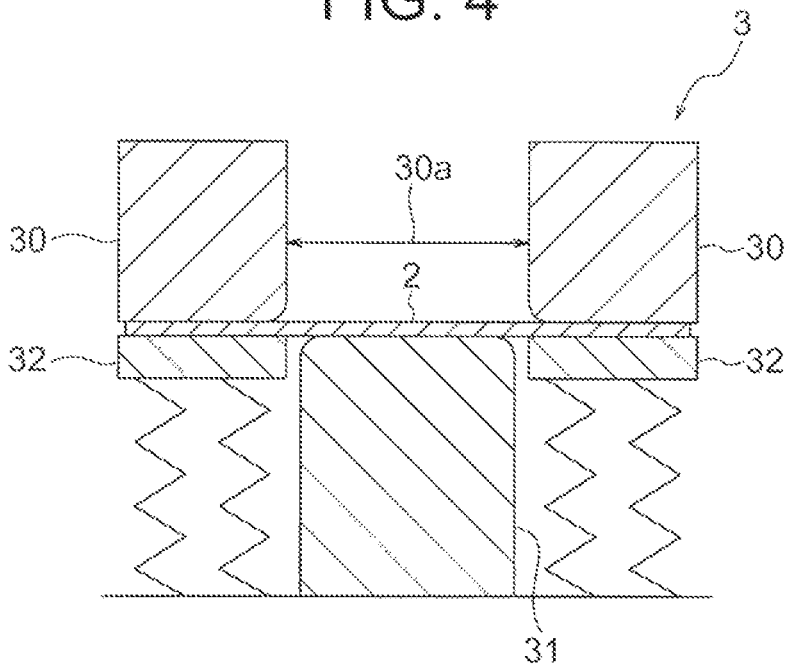
FIG. 4 is an illustrative view showing a mold used during a drawing-out process of FIG. 3.
Figure 5:
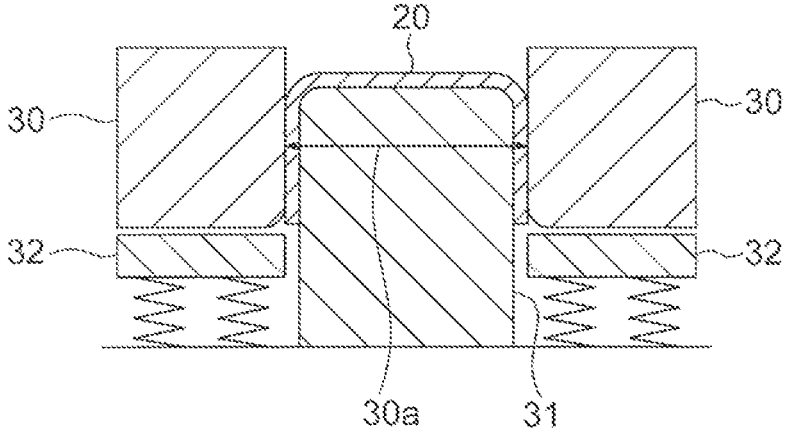
FIG. 5 is an illustrative view showing the drawing-out process using the mold of FIG. 4.

FIG. 4 is an illustrative view showing a mold 3 used during the drawing-out process of FIG. 3, and FIG. 5 is an illustrative view showing the drawing-out process performed using the mold 3 of FIG. 4. As shown in FIG. 4, the mold 3 used in the drawing-out process includes a die 30, a punch 31, and a cushion pad 32. A pushing hole **30*a* into which the raw material metal plate 2 is pushed together with the punch 31 is provided in the die 30. The cushion pad 32 is disposed in an outer peripheral position of the punch 31 so as to face an outer end surface of the die 30. As shown in FIG. 5, an outer edge portion of the raw material metal plate 2 is not completely constrained by the die 30 and the cushion pad 32, and therefore, during the drawing-out process, the outer edge portion of the raw material metal plate 2 is drawn out until it escapes from the constraint applied thereto by the die 30 and the cushion pad 32. The entire raw material metal plate 2 may be pushed into the pushing hole 30*a* together with the punch 31** and drawn out.

Figure 6:
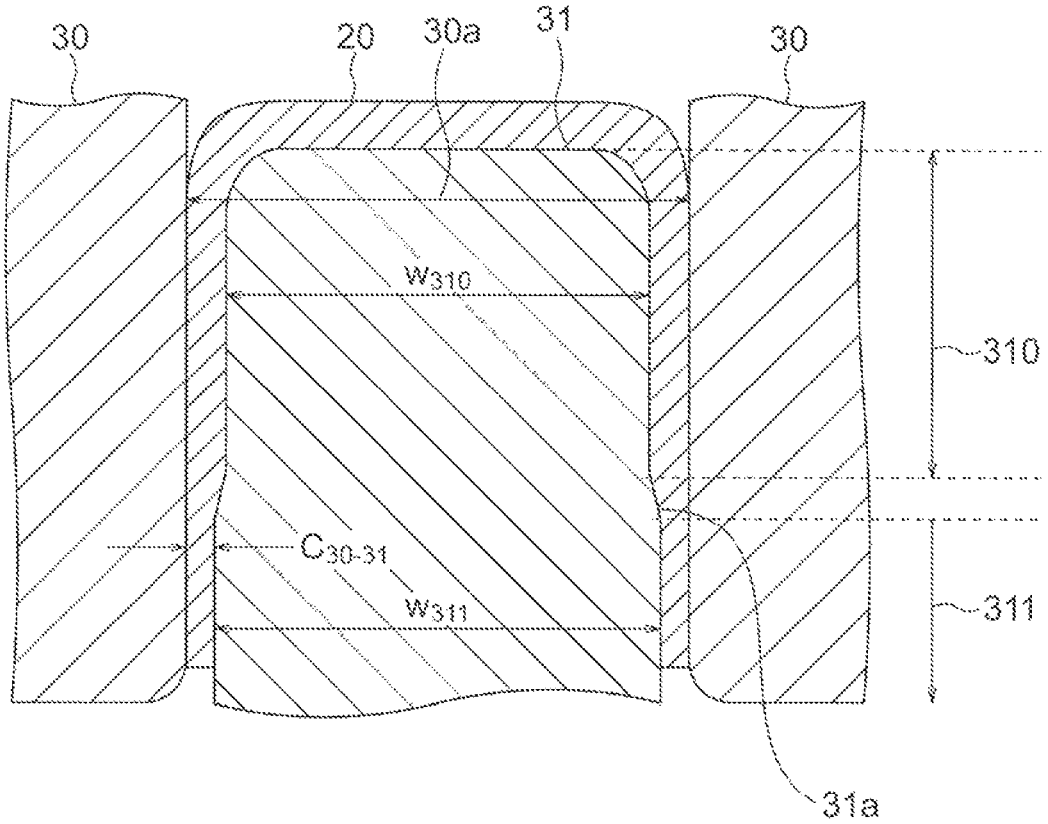
FIG. 6 is an illustrative view showing a punch of FIG. 4 in more detail.

FIG. 6 is an illustrative view showing the punch 31 of FIG. 4 in more detail. As shown in FIG. 6, a width $w_{311}$ of a rear end side 311 of the punch 31 used in the drawing-out process is greater than a width $w_{310}$ of a tip end side 310 of the punch 31. A width of the pushing hole **30*a*, meanwhile, is set to be substantially uniform in an insertion direction in which the punch 31 is inserted into the pushing hole 30*a*. In other words, an inner wall of the die 30 extends substantially parallel to the insertion direction of the punch 31**.

Hence, as shown in FIG. 6, a clearance $c_{30\text{-}31}$ between the die 30 and the punch 31 in a condition where the punch 31 is pushed into the pushing hole **30*a* is narrower on the rear end side 311 of the punch 31 than on the tip end side 310 of the punch 31. The clearance $c_{30\text{-}31}$ on the rear end side 311 of the punch 31 is set to be narrower than the plate thickness of the raw material metal plate 2 before the drawing-out process is performed. Therefore, by pushing the raw material metal plate 2 into the pushing hole 30*a* together with the punch 31 in the drawing-out process, ironing is performed on the outer edge portion of the raw material metal plate 2, or in other words a region of the raw material metal plate 2 corresponding to the flange portion 11. As a result of the ironing, the plate thickness of the region corresponding to the flange portion 11** is reduced (thinned).

Note that a width variation portion **31*a* constituted by an inclined surface on which a width of the punch 31 varies continuously is provided between the tip end side 310 and the rear end side 311 of the punch 31. The width variation portion 31***a* is disposed so as to contact a region of the raw material metal plate 2 corresponding to the lower side shoulder portion Rd (see FIG. 2) between the width variation portion 31*a* and the inner wall of the die 30 when the raw material metal plate 2 is pushed into the pushing hole 30*a* together with the punch 31 during the drawing-out process.

Figure 7:
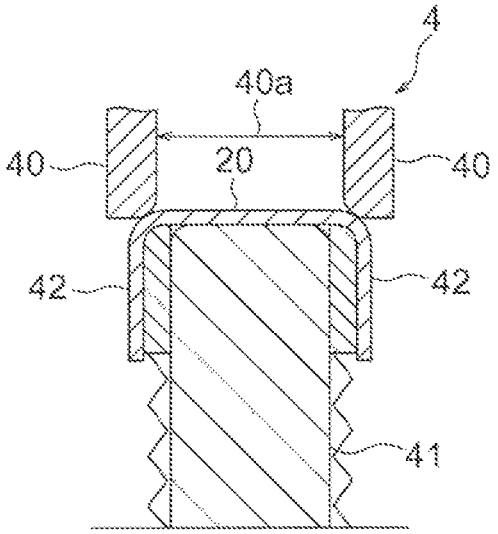
FIG. 7 is an illustrative view showing a mold used during a first drawing process of FIG. 3.
Figure 8:
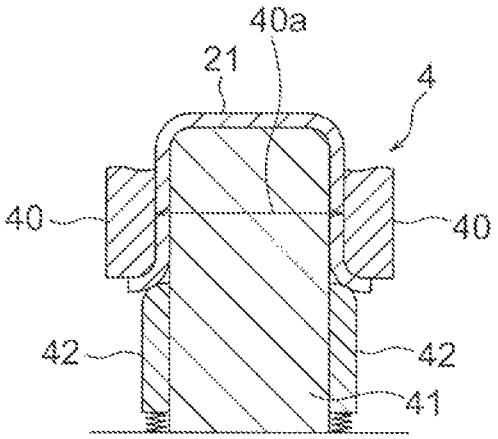
FIG. 8 is an illustrative view showing the first drawing process using the mold of FIG. 7.

FIG. 7 is an illustrative view showing a mold 4 used during the first drawing process of FIG. 3, and FIG. 8 is an illustrative view showing the first drawing process performed using the mold 4 of FIG. 7. As shown in FIG. 7, the mold 4 used in the first drawing process includes a die 40, a punch 41, and a drawing sleeve 42. A pushing hole 40*a* into which a first intermediate body 20, formed in the drawing-out process described above, is pushed together with the punch 41 is provided in the die 40. The drawing sleeve 42 is disposed in an outer peripheral position of the punch 41 so as to face an outer end surface of the die 40. As shown in FIG. 8, in the first drawing process, drawing is performed on a region of the first intermediate body 20 corresponding to the trunk portion 10, and the flange portion 11 is formed by constraining an outer edge portion of the first intermediate body 20 between the die 40 and the drawing sleeve 42. Note that the purpose of the sleeve 42 is to prevent the occurrence of creases during the drawing, and therefore the sleeve 42 may be omitted when no creases occur.

Although not shown in the drawing, the second and third drawing processes of FIG. 3 may be implemented using a conventional mold. In the second drawing process, further drawing is performed on a region of a second intermediate body 21 (see FIG. 3), formed in the first drawing process, corresponding to the trunk portion 10. The third drawing process corresponds to a restriking process, in which ironing is performed on a region of a third intermediate body 22 (see FIG. 3), formed in the second drawing process, corresponding to the trunk portion 10.

In the first to third drawing processes, shrinkage occurs in the region corresponding to the flange portion 11, leading to an increase in the thickness of this region. By ensuring that the plate thickness of the region corresponding to the flange portion 11 is reduced sufficiently in the drawing-out process, however, the plate thickness $t_{11}$ of the flange portion 11 can be made thinner than the plate thickness $t_{101}$ of the peripheral wall 101 of the trunk portion 10 in the final formed material 1. An amount by which the plate thickness of the region corresponding to the flange portion 11 is reduced during the drawing-out process can be adjusted appropriately by modifying the clearance $c_{30\text{-}31}$ on the rear end side 311 of the punch 31 of the mold 3 used in the drawing-out process.

Next, examples will be described. The present inventors performed the drawing-out process under the following processing conditions using, as the raw material metal plate 2, a circular plate having a thickness of 1.8 mm and a diameter of 116 mm and formed by implementing Zn—Al—Mg plating on common cold rolled steel plate. Here, the Zn—Al—Mg alloy plating was implemented on both surfaces of the steel plate, and a plating coverage was set at 90 g/m$^2$ on each surface.

Ironing rate of region corresponding to flange portion 11: −20 to 60%

Curvature radius of mold 3: 6 mm

Diameter of pushing hole 30*a*: 70 mm

Diameter of tip end side 310 of punch 31: 65.7 mm

Diameter of rear end side 311 of punch 31: 65.7 to 68.6 mm

Shape of width variation portion 31*a*: Inclined surface or right-angled step Position of width variation portion 31*a*: Region corresponding to lower side shoulder portion Rd, region corresponding to flange portion 11, or region corresponding to trunk portion 10

Press forming oil: TN-20

<Evaluation of Ironing Rate>

At an ironing rate of 30% or lower (i.e. when the diameter of the rear end side 311 of the punch 31 was no greater than 67.5 mm), the processing could be performed without problems. When the ironing rate was higher than 30% and no higher than 50% (when the diameter of the rear end side 311 of the punch 31 was greater than 67.5 mm and no greater than 68.2 mm), on the other hand, a slight dragging mark was found in a part that slides against the die 30. Further, when the ironing rate exceeded 50% (when the diameter of the rear end side 311 of the punch 31 was greater than 67.9 mm), galling and cracking occurred against the inner wall of the die 30. It was therefore learned that the ironing rate of the region corresponding to the flange portion 11 during the drawing-out process is preferably no higher than 50%, and more preferably no higher than 30%. Note that the ironing rate is defined as {(pre-ironing plate thickness−post-ironing plate thickness)/pre-ironing plate thickness}×100. Here, a value of the plate thickness of the raw material metal plate can be used as the pre-ironing plate thickness.

<Evaluation of Shape of Width Variation Portion 31*a*>

When the width variation portion 31*a* was constituted by an inclined surface, as shown in FIG. 6, the processing could be performed without problems. On the other hand, when the width variation portion 31*a* was constituted by a right-angled step, or in other words when the tip end side 310 and the rear end side 311 of the punch 31 were defined by a single step, plating residue was generated in a location contacting the right-angled step. It was therefore learned that the width variation portion 31*a* is preferably constituted by an inclined surface.

<Evaluation of Position of Width Variation Portion 31*a*>

When the width variation portion 31*a* was provided in contact with the region corresponding to the lower side shoulder portion Rd, it was possible to perform ironing favorably in the region corresponding to the flange portion 11. When the width variation portion 31*a* was provided in contact with the region corresponding to the flange portion 11, on the other hand, a part of the flange portion 11 could not be reduced in thickness sufficiently. Further, when the width variation portion 31*a* was provided in contact with the region corresponding to the trunk portion 10, a part of the trunk portion 10 became thinner than the target plate thickness. It was therefore learned that the width variation portion 31*a* is preferably provided in contact with the region corresponding to the lower side shoulder portion Rd.

Figure 9:
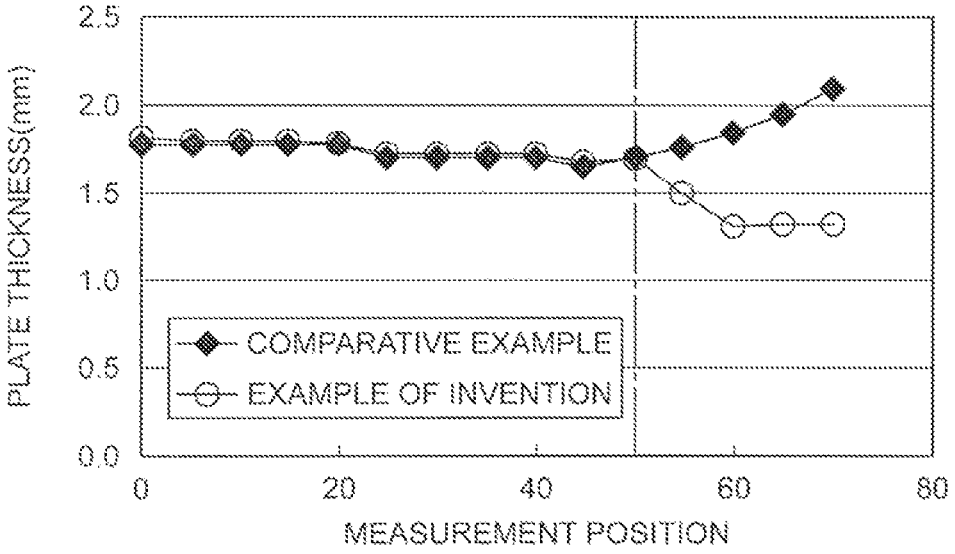
FIG. 9 is a graph showing differences in plate thickness of a first intermediate body when an ironing rate is varied.
Figure 10:
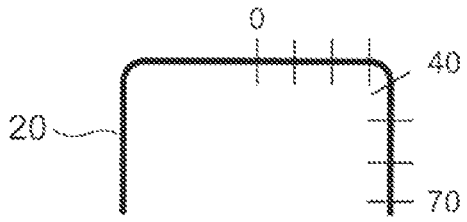
FIG. 10 is an illustrative view showing plate thickness measurement positions of FIG. 9.

FIG. 9 is a graph showing differences in the plate thickness of the first intermediate body 20 when the ironing rate is varied. Further, FIG. 10 is an illustrative view showing plate thickness measurement positions of FIG. 9. FIG. 9 shows a plate thickness of the first intermediate body 20 when the drawing-out process was performed at an ironing rate of −20% (a comparative example) and a plate thickness of the first intermediate body 20 when the drawing-out process was performed at an ironing rate of 30% (the example of the invention). As shown in FIG. 9, when the drawing-out process was performed at an ironing rate of 30%, the plate thickness in the region corresponding to the flange portion 11 (measurement positions 50 to 70) was thinner than the plate thickness (1.8 mm) of the raw material metal plate 2. When the drawing-out process was performed at an ironing rate of 0%, on the other hand, the plate thickness in the region corresponding to the flange portion 11 (measurement positions 50 to 70) was thicker than the plate thickness (1.8 mm) of the raw material metal plate 2.

Figure 11:
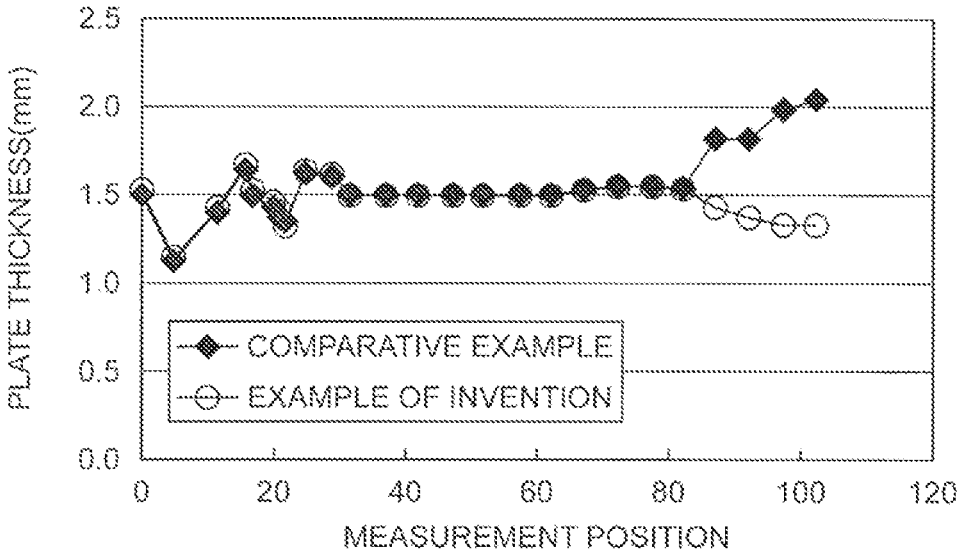
FIG. 11 is a graph showing plate thicknesses of formed materials manufactured from respective first intermediate bodies of FIG. 9.
Figure 12:
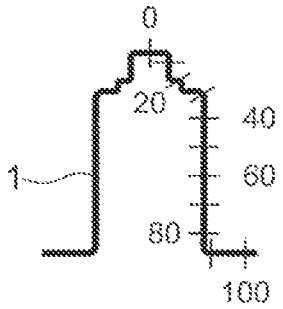
FIG. 12 is an illustrative view showing plate thickness measurement positions of FIG. 11.

FIG. 11 is a graph showing plate thicknesses of the formed materials 1 manufactured from the respective first intermediate bodies 20 of FIG. 9, and FIG. 12 is an illustrative view showing plate thickness measurement positions of FIG. 11. As shown in FIG. 11, differences in the plate thickness at the stage of the first intermediate body 20 appear as is in the formed material 1. In other words, it was learned that by performing a drawing-out process that includes ironing before the drawing process, the thickness of the flange portion 11 can be reduced in the final formed material 1. When the formed material 1 subjected to a drawing-out process including ironing (the example of the invention) and the formed material 1 not subjected to a drawing-out process including ironing (the comparative example) were formed at identical dimensions, the example of the invention weighed approximately 10% less than the comparative example.

Note that when a drawing-out process including ironing is performed, the region of the raw material metal plate 2 corresponding to the flange portion 11 is stretched. To form the formed material 1 subjected to a drawing-out process including ironing (the example of the invention) and the formed material 1 not subjected to a drawing-out process including ironing (the comparative example) at identical dimensions, either a smaller raw material metal plate 2 may be used while taking into consideration an amount by which the region corresponding to the flange portion 11 is stretched or an unnecessary part of the flange portion 11 may be trimmed.

In the formed material manufacturing method and the formed material 1 manufactured thereby, as described above, ironing is performed on the region of the raw material metal plate 2 corresponding to the flange portion 11 during the drawing-out process by pushing the raw material metal plate 2 into the pushing hole 30*a* together with the punch 31, and therefore an unnecessary increase in the thickness of the flange portion 11 can be avoided, enabling a reduction in the weight of the formed material 1. This configuration is particularly useful in an application such as a motor case, in which the formed material must be lightweight and the raw material metal plate must be small.

Further, the ironing rate of the ironing performed during the drawing-out process is set at no higher than 50%, and therefore galling and cracking can be avoided.

Furthermore, the width variation portion 31*a* constituted by the inclined surface on which the width of the punch 31 varies continuously is provided between the tip end side 310 and the rear end side 311 of the punch 31, and therefore plating residue caused by contact with the width variation portion 31*a* during the ironing can be avoided.

Moreover, the width variation portion 31*a* is disposed in contact with the region corresponding to the lower side shoulder portion Rd formed between the peripheral wall 101 of the trunk portion 10 and the flange portion 11, and therefore the flange portion 11 can be reduced in thickness sufficiently and the trunk portion 10 can be set at the target plate thickness more reliably.

Note that in the embodiment described above, the drawing-out process is performed only once, but two or more drawing-out processes may be performed before the drawing process. By performing a plurality of drawing-out processes, the thickness of the flange portion 11 can be reduced more reliably. Performing a plurality of drawing-out processes is particularly effective when the raw material metal plate 2 is thick. Note that even when a plurality of drawing-out processes are performed, the ironing rate of each process is still preferably set at no higher than 50% to avoid galling and the like. Further, by setting the ironing rate at 30% or lower, marks can also be avoided.

Furthermore, in the embodiment described above, the drawing process is performed three times, but the number of drawing processes may be modified appropriately in accordance with the size and required dimensional precision of the formed material 1.

The invention claimed is:

1. A formed material manufacturing method for manufacturing a formed material having a tubular trunk portion and a flange portion formed on an end portion of the trunk portion, by performing at least two forming processes on a raw material metal plate, wherein the at least two forming processes include at least one drawing-out process and at least one drawing process performed after the drawing-out process, performing the drawing-out process by using a mold that includes a punch and a die having a pushing hole, wherein the drawing-out process, the mold receives the raw material metal plate having a substantially flat plate shape, wherein a width of a rear end side of the punch is set to be wider than a width of a tip end side thereof so that a clearance between the die and the punch when the punch is pushed into the pushing hole in the die is narrower on the rear end side than on the tip end side, and ironing a region of the raw material metal plate corresponding to the flange portion by pushing the raw material metal plate into the pushing hole together with the punch during the drawing-out process, and wherein a width variation portion constituted by an inclined surface on which a width of the punch varies continuously is provided between the tip end side and the rear end side of the punch, and the width variation portion is disposed in contact with a region corresponding to a shoulder portion formed between a peripheral wall of the trunk portion and the flange portion.

2. The formed material manufacturing method according to claim 1, wherein an ironing rate of the ironing is 50% or lower.

3. The formed material manufacturing method according to claim 1, characterized in that a plate thickness of the flange portion of the formed material is set to be thinner than a plate thickness of the raw material metal plate.

4. The formed material manufacturing method according to claim 1, wherein the shoulder portion defines a bend portion separating the flange portion from the peripheral wall of the trunk portion.

5. A formed material manufactured by performing at least two forming processes on a raw material metal plate, the formed material having a tubular trunk portion and a flange portion formed on an end portion of the trunk portion, and the at least two forming processes including at least one drawing-out process and at least one drawing process performed after the drawing-out process, wherein the drawing-out process includes a mold receiving the raw material metal plate having a substantially flat plate shape, wherein a plate thickness of the flange portion is thinner than a plate thickness of a peripheral wall of the trunk portion by performing ironing on only a region of the raw material metal plate corresponding to the flange portion and a shoulder portion formed between a peripheral wall of the trunk portion and the flange portion during the drawing-out process.

6. A formed material manufactured by performing at least two forming processes on a raw material metal plate, the formed material having a tubular trunk portion and a flange portion formed on an end portion of the trunk portion, and the at least two forming processes including at least one drawing-out process and at least one drawing process performed after the drawing-out process, wherein the drawing-out process includes a mold receiving the raw material metal plate having a substantially flat plate shape, wherein a plate thickness of the flange portion is thinner than a plate thickness of the raw material metal plate by performing ironing on only a region of the raw material metal plate corresponding to the flange portion and a shoulder portion formed between a peripheral wall of the trunk portion and the flange portion during the drawing-out process.

* * * * *